US009345912B2

(12) United States Patent
Wells

(10) Patent No.: US 9,345,912 B2
(45) Date of Patent: May 24, 2016

(54) MULTI-USE FIREFIGHTING TOOL

(71) Applicant: Ryan Wells, Saratoga, WY (US)

(72) Inventor: Ryan Wells, Saratoga, WY (US)

(73) Assignee: ON SCENE SOLUTIONS, LLC, Ft. Collins, CO (US)

( * ) Notice: Subject to any disclaimer, the term of this patent is extended or adjusted under 35 U.S.C. 154(b) by 228 days.

(21) Appl. No.: 14/066,275

(22) Filed: Oct. 29, 2013

(65) Prior Publication Data

US 2015/0113738 A1 Apr. 30, 2015

(51) Int. Cl.
*A62B 3/00* (2006.01)
*A62C 8/00* (2006.01)

(52) U.S. Cl.
CPC ..... *A62B 3/005* (2013.01); *Y10T 29/49826* (2015.01)

(58) Field of Classification Search
CPC ..... B27L 7/06; A01G 23/099; A62C 8/00; B66F 15/00
See application file for complete search history.

(56) References Cited

U.S. PATENT DOCUMENTS 165,984 A * 7/1875 Cosbey ..... B27L 7/06 254/104
1,749,103 A 3/1930 Kortick
1,884,990 A 10/1932 Funke
3,185,442 A * 5/1965 Hemphill ..... A01G 23/099 254/104
3,705,430 A 12/1972 Ziaylek, Jr.
4,465,113 A * 8/1984 Hillinger ..... B27L 7/06 144/195.5
4,926,558 A * 5/1990 Brace ..... B27L 7/06 144/195.5
5,095,623 A 3/1992 Williams
6,367,107 B1 4/2002 Corsini
D591,578 S 5/2009 Harpell
7,634,830 B2 * 12/2009 Ryan ..... A62B 3/00 7/138
D617,624 S 6/2010 Tygh
7,726,713 B2 6/2010 Oleksia
7,735,172 B2 * 6/2010 Newton ..... A62C 8/00 7/145
7,774,882 B2 8/2010 Liou
7,845,254 B2 12/2010 Lionel
7,900,538 B2 3/2011 Phillips et al.
D637,462 S 5/2011 Glynn et al.
D644,083 S 8/2011 Dapkins, Jr. et al.
D655,142 S 3/2012 Glynn et al.
8,127,387 B2 3/2012 Tygh
8,550,437 B2 * 10/2013 Liou ..... B25F 1/00 254/115
8,794,597 B1 8/2014 Ingesson et al.
2002/0134971 A1 9/2002 Christensen
2003/0102468 A1 * 6/2003 Selzer ..... A62B 3/005 254/104
2004/0261188 A1 12/2004 Mathis
2009/0000097 A1 1/2009 Dapkins, Jr. et al.
2010/0299843 A1 12/2010 Dapkins, Jr. et al.

OTHER PUBLICATIONS

Official Action for U.S. Appl. No. 29/460,172, mailed Nov. 28, 2014, 7 pages.
U.S. Appl. No. 29/460,172, filed Jul. 9, 2013, Wells.
"Product Catalog," On Scene Solutions, 2013, 5 pages.

* cited by examiner

*Primary Examiner* — David B Thomas
(74) *Attorney, Agent, or Firm* — Sheridan Ross P.C.

(57) ABSTRACT

The present invention provides a multi-use firefighting tool. The tool may be used as a stand-alone tool or as a supplement to existing tools. An additional aspect of the present invention is to provide a multi-use tool configured to enable, among other things, forcible entry and valve opening/closing. Further, the tool may be used to supplement a firefighting Halligan tool.

20 Claims, 6 Drawing Sheets

DETAIL A
SCALE 2 : 1

DETAIL B
SCALE 2 : 1

MULTI-USE FIREFIGHTING TOOL

CROSS REFERENCE TO RELATED APPLICATIONS

This application incorporates by reference in its entirety U.S. Design patent application No. 29/460,172, filed Jul. 9, 2013.

FIELD OF THE INVENTION

Embodiments of the present invention are generally related to a multi-use firefighting tool, and, in particular, to an apparatus and method for forcible entry as a stand-alone tool or as a supplement to existing tools.

BACKGROUND OF THE INVENTION

Firefighters are routinely confronted with unpredictable situations requiring the assistance of tools. For example, a locked door may be encountered preventing inspection of a particular room, or an electrical panel may be rusted shut. In such situations, firefighting tools may facilitate or enable forcible entry or access by wedging, prying or breaking. Other tools may function to open or close a fire hydrant or a gas meter, and rip into walls to search for fire sources. Frequently, firefighters carry multiple tools to serve a variety of needs, in the hope that the tools will adapt to the immediate need and not require the added time and risk of returning to a staging area to retrieve an additional tool. A common default set of tools, or "set of irons," for a firefighter to carry are a halligan tool and a flat-head axe.

Traditional multi-use firefighting tools have been developed to combine common tool capabilities. In practice, while some multi-use tools have beneficial uses, they are not widely used, because, for example, they do not align or engage with the common set of irons carried by firefighters or are cumbersome to use.

Some efforts have been made to improve the tools for firefighting application. For example, U.S. Pat. No. 5,095,623 to Williams ("Williams") discloses a firefighting tool having a flat blade with a pointed leading end for piercing through structural panels, stop teeth for engaging a structural panel that has been pierced, and rip teeth for sawing through structural panels when the tool is reciprocated along its longitudinal axis. The stop teeth are positioned at an angle relative to the rip teeth. The tool may be maintained in an overhead configuration when used to remove ceiling panels because the angle of the stop teeth provide a hooking action enabling the ceiling to support the tool weight. Because the stop teeth defeat inadvertent withdrawal of the blade, the firefighter need not make multiple penetrations of ceiling panels or other structural members being removed by the tool. However, Williams fails to teach several novel features of the present invention, including a multi-use tool configured to enable forcible entry and valve opening/closing, and adapted to supplement a firefighting halligan tool. Williams is incorporated by reference in its entirety.

U.S. Pat. No. 7,726,713 to Oleksia ("Oleksia") discloses a multi-use tool having a generally J-shaped hook structure with a top portion, a middle shank portion and a curved bottom portion. The top portion has a loop to which a rope, life-line or escape line can be fastened. The curved bottom portion extends to a beveled tip. The multi-use tool also has a protruding member that extends from the curved bottom portion and has a substantially flat top surface and a substantially flat bottom surface. However, Oleksia fails to teach several novel features of the present invention, including a multi-use tool configured to enable forcible entry and valve opening/closing, and adapted to supplement a firefighting halligan tool. Oleksia is incorporated by reference in its entirety.

U.S. Pat. No. 3,705,430 to Ziaylek, Jr. ("Ziaylek") discloses a forcible entry tool having a shank portion, a tail portion and a head portion. The head consists of a spike extending normal to the axis of the shank and wedge and wrench portions extending mutually opposite from each other along a line extending generally normal to both the extension of the shaft and that of the spike. The wedge and wrench portions consist of approximately equal masses so that when an impact is applied to an object by the spike portion. Any lateral turning moment about the spike is minimized. The wrench is formed as an extension of the wedge portion and presents an arcuate upper surface extending between the two so that when the wedge is used, a greater fulcrum distance is provided. Furthermore, in using the wrench portion, both the shank portion and the wedge may be utilized as a dual handle system for applying additional torque to a hose coupling and the like. The shank may be formed to bend away from the side presenting the wrench to facilitate the application of torque to a hose coupling when using the wrench. However, Ziaylek fails to teach several novel features of the present invention, including a multi-use tool configured to enable forcible entry and valve opening/closing, and adapted to supplement a firefighting halligan tool. Ziaylek is incorporated by reference in its entirety.

Some efforts have been made to provide firefighting tools that feature multiple uses. For example, U.S. Pat. No. 7,845,254 to Lionel ("Lionel") discloses a firefighter pocket tool combining the functional features of several traditional tools (slip groove pliers of the curved jaw type, 6 in 1 screwdriver, spanner wrench, gas shut-off tool and a striking tool) onto a shared single structure. The tool comprises a pair of slip groove pliers each having a jaw portion, a joint portion and a handle portion, a pivotal bolt, nut and spring member. A protrusion on the upper rear portion of the pliers' upper jaw's head forms a striking surface and a hook and claw which can be used as a spanner for rocker lug type and similar fire hose couplings. A gas shut off loop can be used as a finger guard when the tool is being used as a striking implement. However, Lionel fails to teach several novel features of the present invention, including a multi-use tool configured to enable forcible entry and valve opening/closing, and adapted to supplement a firefighting halligan tool. Lionel is incorporated by reference in its entirety.

U.S. Pat. No. 8,127,387 to Tygh ("Tygh") discloses a manually held firefighting tool with an elongated staff section comprising working members at each end. The first working member has a claw element and a spike element, each extending perpendicularly to the longitudinal axis of the staff section and protruding from the staff section in opposite directions. The second working member extends from the second end of the staff section and has a U-shaped yoke element supporting an arcuate cross bar element positioned parallel to the longitudinal axis of the staff section. The second working member has its own claw element at one end and a spike element at the other end. A flat bar element is affixed perpendicularly to the cross bar element between its two ends. However, Tygh fails to teach several novel features of the present invention, including a multi-use tool configured to enable forcible entry and valve opening/closing, and adapted to supplement a firefighting halligan tool. Tygh is incorporated by reference in its entirety.

U.S Patent Application Publication No. US 2004/0261188 to Mathis ("Mathis") discloses a combination tool for use in fighting fires, search and rescue, forcible entry, auto extrications, and salvage and overhaul. An axe/hammer head member is attached to an elongated handle pry bar of various sizes. The handle pry bar forms itself on either side of the axe/hammer head acting as a chop stop for both axe/hammer member. The pry bar member provides a water/gas shut off tool as well as a pry tool. The axe underside is a 3-in-1 tool providing a hydrant wrench, windshield and dry wall cutter. The cutters are used when the axe is supplanted past the dry wall or windshield and pulled. The hammer underside provides a spanner wrench for hoses and the common stortz coupling on fire trucks. However, Mathis fails to teach several novel features of the present invention, including a multi-use tool configured to enable forcible entry and valve opening/closing, and adapted to supplement a firefighting halligan tool. Mathis is incorporated by reference in its entirety.

Finally, some efforts have been made to provide firefighting tools that engage other firefighting tools. U.S. Pat. No. 6,367,107 to Corsini ("Corsini") discloses a striking tool for interlocking with a bar-like tool having a fork end and/or a pike end. The striking tool uses two retaining features for retaining a bar-like tool. The pike can be replaced by or supplemented with an adz, or any other type of extrusion. The bar-like tool may be a halligan tool. The striking tool is preferably an axe having a handle and a striking head anchored to the handle. One of the bar-like-tool retaining features is located on the striking head and the other retaining feature is located on the handle. The two tools are detachably interlocked for storage or carrying purposes. However, Corsini fails to teach several novel features of the present invention, including a multi-use tool configured to enable forcible entry and valve opening/closing, and adapted to supplement a firefighting halligan tool. Corsini is incorporated by reference in its entirety.

What is needed is a multi-use tool configured to enable forcible entry and valve opening/closing, and adapted to supplement a firefighting halligan tool.

SUMMARY OF THE INVENTION

It is one aspect of the present invention to provide a multi-use firefighting tool. The tool may be used as a stand-alone tool or as a supplement to existing tools. An additional aspect of the present invention is to provide a multi-use tool configured to enable, among other things, forcible entry and valve opening/closing. Further, the tool may be used to supplement a firefighting halligan tool.

In one embodiment of the invention, a fighting tool is disclosed, the tool comprising: a body having an upper surface, a second surface, a pair of lateral surfaces, a vertical aperture and a lateral cavity, the vertical aperture extending through the body between the upper and second surfaces, the lateral cavity extending through the body between the pair of lateral surfaces; and a wedge interconnected with the body comprising at least a pair of edges defining a slot.

In another embodiment of the invention, a hallagan tool and firefighting tool assembly is disclosed, the assembly comprising: a body having an upper surface, a second surface, a pair of lateral surfaces, a vertical aperture and a lateral cavity, the lateral cavity extending through the body between the pair of lateral surfaces, the vertical aperture adapted to engage a pick of a hallagan tool and the lateral cavity adapted to engage an adz of the hallagan tool, the pick and the adz at a distal end of the hallagan tool; and a firefighting tool interconnected to the body, the firefighting tool including a wedge portion comprising at least a pair of edges defining a slot; wherein the firefighting tool extends from the distal end of the halligan when the firefighting tool is engaged with one of the pick and the adz of the halligan tool.

In yet another embodiment of the invention a method of using a hallagan tool and firefighting tool assembly is disclosed, the method comprising: providing a firefighting tool, the tool comprising: a body having an upper surface, a second surface, a pair of lateral surfaces, a vertical aperture and a lateral cavity, the lateral cavity extending through the body between the pair of lateral surfaces, the vertical aperture adapted to engage a pick of a hallagan tool and the lateral cavity adapted to engage an adz of the hallagan tool, the pick and the adz at a distal end of the hallagan tool; and a wedge portion comprising at least a pair of edges defining a slot; providing a halligan tool; interconnecting the halligan tool with the firefighting tool by one of: 1) the pick of the halligan tool with the tool vertical aperture and 2) the adz of the halligan tool with the tool lateral cavity; and engaging an external surface with the hallagan tool and firefighting tool assembly to at least one of force-entry, pry, wedge, strike, hammer, twist and destructively transfer energy.

The term "halligan tool," "halligan bar," "hallagan tool," "hallagan bar" or variations thereof refer to a multi-purpose firefighting tool consisting of a claw at one end, and a pick and adze at the other end.

The term "claw" and "fork" or variations thereof refer to a multi-prong element with an enclosed recess area.

The term "adze" or 'adz," "wedge" and/or "blade" or variations thereof refer to a generally tapered wedge-like element of rectangular cross-section.

This Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention, and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the Detailed Description of the Invention, the drawing figures, and the exemplary claim set forth herein, taken in conjunction with this Summary of the Invention, define the invention.

BRIEF DESCRIPTION OF THE DRAWINGS

The accompanying drawings, which are incorporated in and constitute a part of the specification, illustrate embodiments of the invention and together with the general description of the invention given above, and the detailed description of the drawings given below, serve to explain the principals of this invention.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
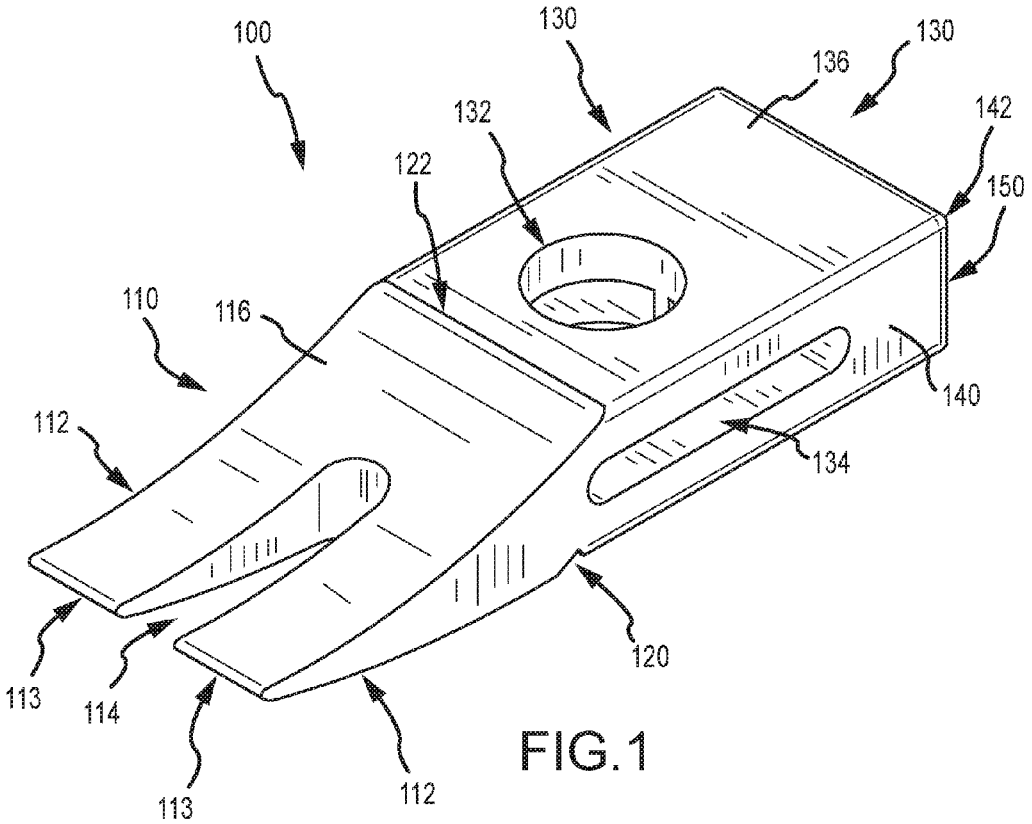
FIG. 1 depicts a front perspective view of the multi-use firefighting tool according to one embodiment of the present invention.

FIG. 1 depicts a perspective view and FIGS. 2A-D depict respective front, top, left side and cross-sectional views of the multi-use Firefighting Tool 100 according to one embodiment of the present invention. Referring to FIGS. 1 and 2A-D, the elements of the Firefighting Tool 100 are provided. Firefighting Tool 100 generally comprises Firefighting Tool Body 130 interconnected to a Firefighting Tool Wedge 110. The Firefighting Tool Body 130 comprises Firefighting Tool Body Vertical Aperture 132, Firefighting Tool Body Horizontal Cavity 134, Firefighting Tool Body First Surface 136, Firefighting Tool Body Second Surface 138, Firefighting Tool Body Lateral Surface 140, Firefighting Tool Body Edges 142 and Firefighting Tool Body Face 150. Firefighting Tool Wedge 110 comprises two Firefighting Tool Wedge Prongs 112, each comprising Firefighting Tool Wedge Prong Edge 113. Firefighting Tool Wedge Slot 114 comprises Firefighting Tool Wedge Slot Distal End 115, Firefighting Tool Wedge First Surface 116 and Firefighting Tool Wedge Second Surface 118. Firefighting Tool Wedge/Body Transition 122 is disposed between Firefighting Tool Body First Surface 136 and Firefighting Tool Wedge First Surface 116. Firefighting Tool Groove 120 is disposed between Firefighting Tool Body Second Surface 138 and Firefighting Tool Wedge Second Surface 118.

Figure 2B:
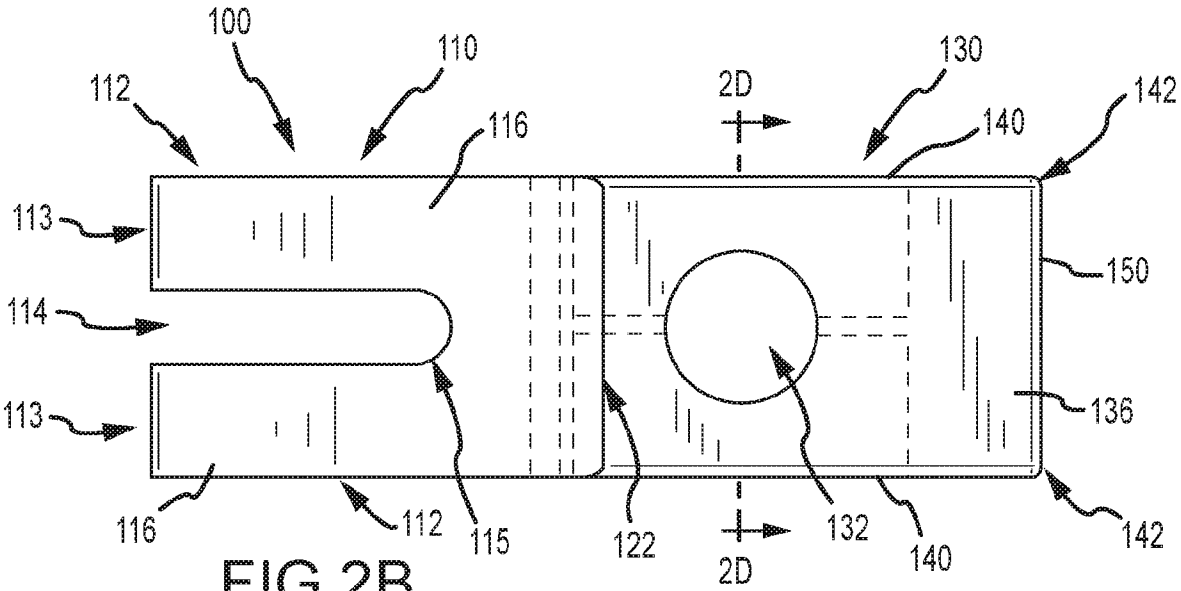
FIG. 2B depicts a top plan view of the multi-use firefighting tool of FIG. 1 according to one embodiment of the present invention.
Figure 2C:
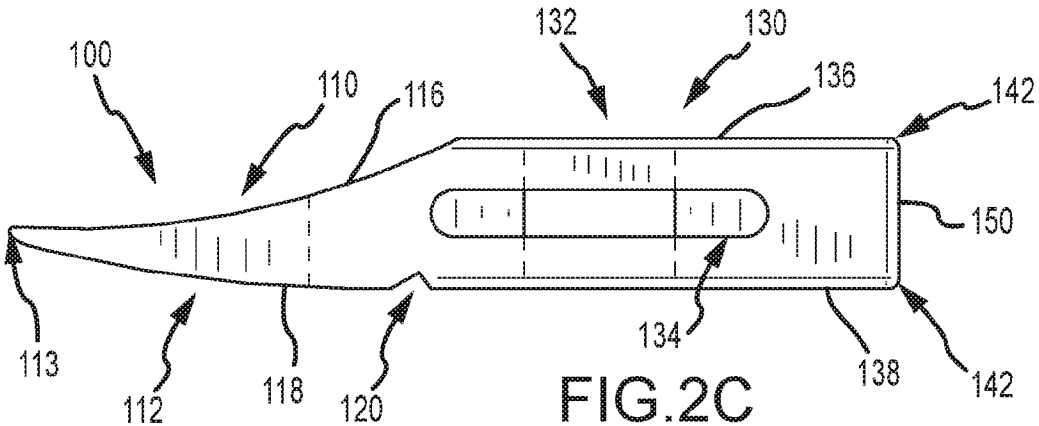
FIG. 2C depicts a left elevation view of the multi-use firefighting tool of FIG. 1 according to one embodiment of the present invention.
Figure 2A:
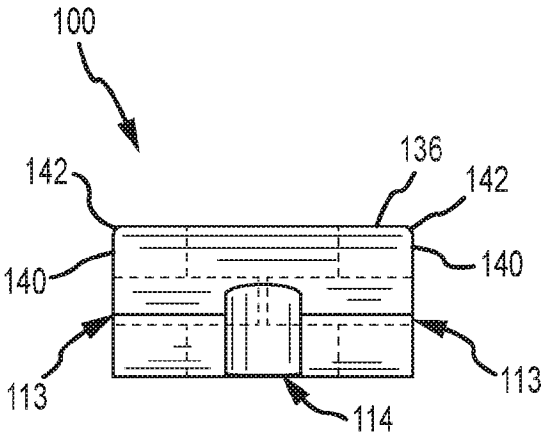
FIG. 2A depicts a front elevation view of the multi-use firefighting tool of FIG. 1 according to one embodiment of the present invention.
Figure 2D:
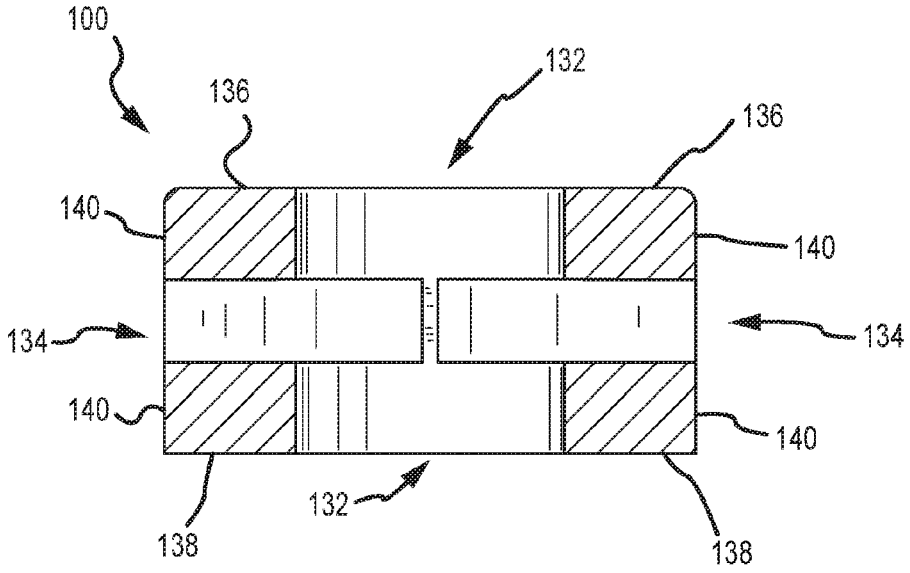
FIG. 2D depicts a cross-sectional view of Section 2D-2D of FIG. 2C.
Figure 3A:
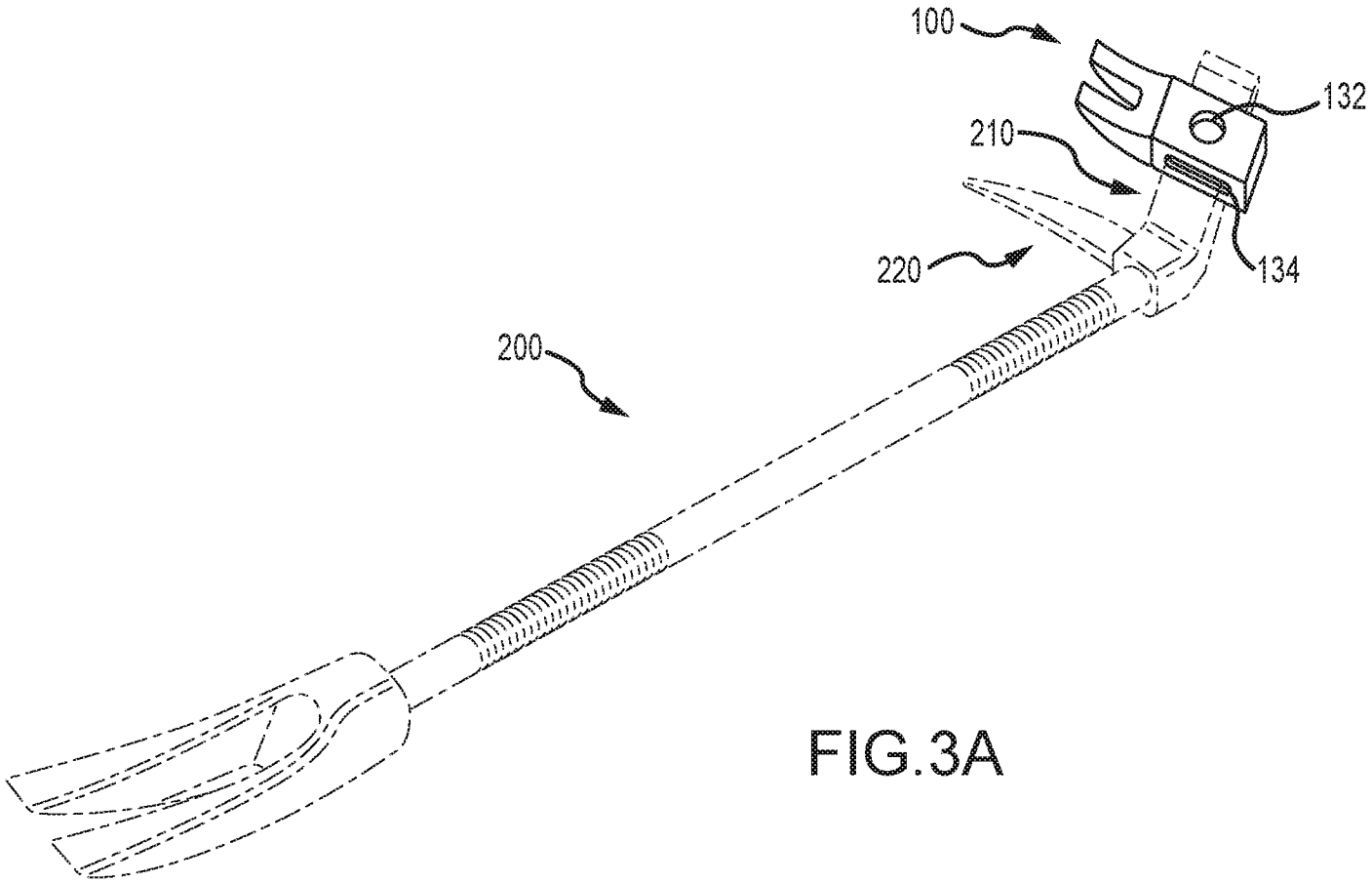
FIG. 3A depicts a front perspective view of the multi-use firefighting tool of FIG. 1 engaged with the adze of a halligan tool.
Figure 3B:
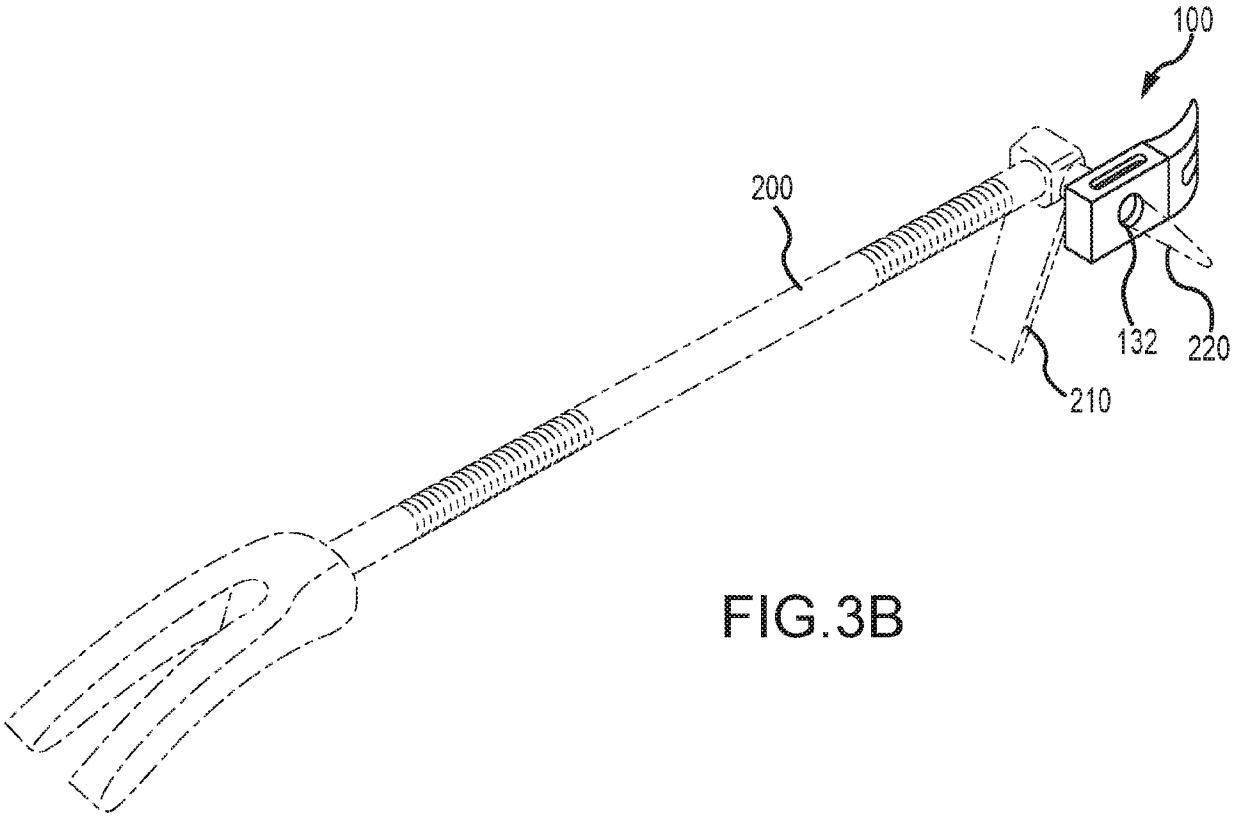
FIG. 3B depicts a front perspective view of the multi-use firefighting tool of FIG. 1 engaged with the pick of a halligan tool.
Figure 4A:
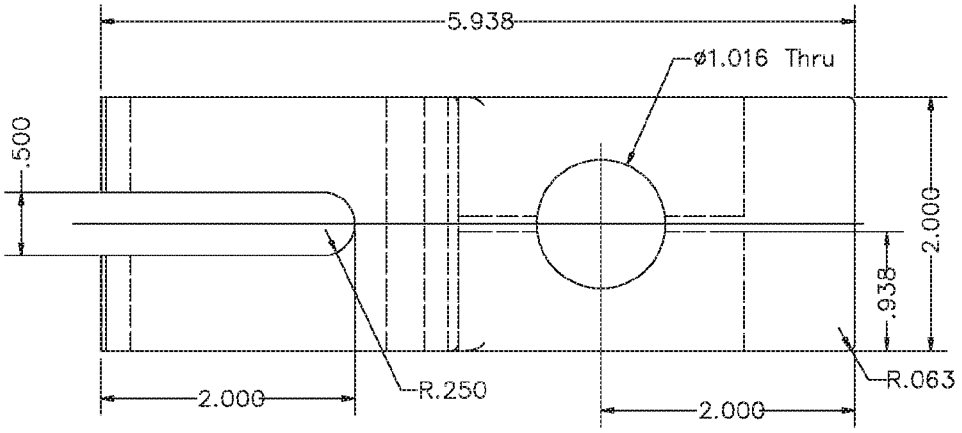
FIG. 4A illustrates a top plan view of an example construction of a particular embodiment of the multi-use firefighting tool—the drawing is to scale with dimensions in inches.
Figure 4B:
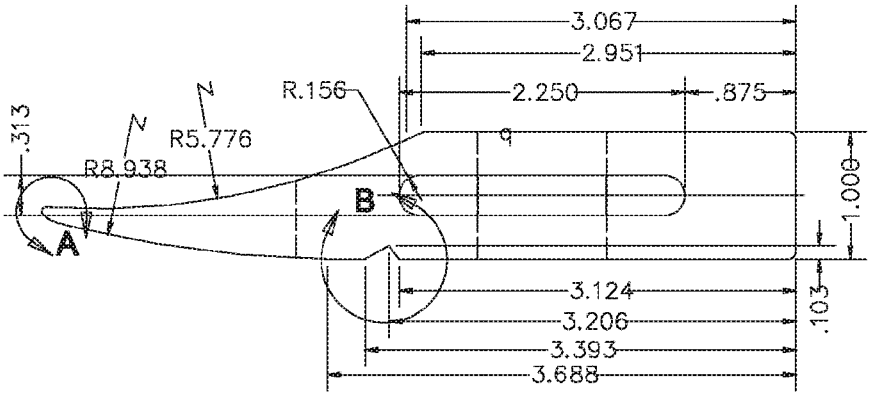
FIG. 4B illustrates a left elevation view of an example construction of a particular embodiment of the multi-use firefighting tool of FIG. 4A—the drawing is to scale with dimensions in inches.
Figure 4C:
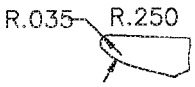
FIG. 4C illustrates a detailed view of Section A of FIG. 4B—the drawing is to scale.
Figure 4D:
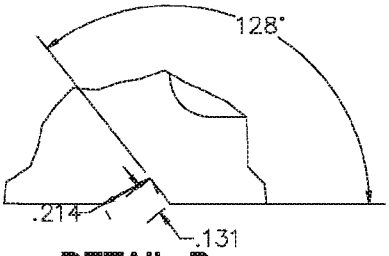
FIG. 4D illustrates a detailed view of Section B of FIG. 4B—the drawing is to scale.

Firefighting Tool Wedge First Surface 116 and Firefighting Tool Wedge Second Surface 118 are generally of a curved profile shape, as shown in FIG. 2C, and form two adjacent and symmetrical Firefighting Tool Wedge Prongs 112. The two Firefighting Tool Wedge Prongs 112 form a Firefighting Tool Wedge Slot 114 therebetween. The two Firefighting Tool Wedge Prongs 112 forming a Firefighting Tool Wedge Slot 114 may be used, for example, to engage and operate a valve, such as a gas meter valve or a fire hydrant valve. The opposing curved surfaces forming the two Firefighting Tool Wedge Prongs 112, i.e. Firefighting Tool Wedge First Surface 116 and Firefighting Tool Wedge Second Surface 118, may be used as a wedge tool. For example, the Firefighting Tool Wedge 110 portion may be inserted under a door to wedge it open or fix its position by placing the either the Firefighting Tool Wedge Second Surface 118 or the Firefighting Tool Wedge First Surface 116 facing the ground and inserting the Firefighting Tool Wedge Prong Edges 113 under the door. In a preferred use, the Firefighting Tool Wedge First Surface 116 is positioned facing the ground when used as a door stop; in such a configuration, the bottom of a door may lodge into the Firefighting Tool Groove 120 for a positive stop. The Firefighting Tool Wedge 110 portion may also be used for other wedging operations or functions, such as an over-the-hinge door wedge in which the Firefighting Tool Wedge Slot 114 of the Firefighting Tool Wedge 110 portion is placed over the door hinge.

Once the Firefighting Tool Wedge 110 portion is engaged in, for example, one of the above scenarios, the Firefighting Tool 100 may be further advanced or forced into or beyond its position solely by hand or through use of the Firefighting Tool Body Face 150. That is, the Firefighting Tool 100 may be struck at its Firefighting Tool Body Face 150 by, for example, a hammer, the flat-end of an axe, or a halligan tool. Similarly, additional or alternative leverage may be imparted to the Firefighting Tool 100 when positioned to function as a wedge by inserting a tool, such as a hallagan tool, into the Firefighting Tool Body Vertical Aperture 132 or the Firefighting Tool Body Horizontal Cavity 134. More specifically, the pick or spike end of a standard hallagan tool may be inserted into the Firefighting Tool Body Vertical Aperture 132 to increase leveraged wedging force of the Firefighting Tool 100 within the cavity in which it is inserted. Also, if the pick or spike end of a standard hallagan tool is inserted into the Firefighting Tool Body Vertical Aperture 132 and urged at an angle other than parallel to the Firefighting Tool Wedge 110 portion, a twisting force or tongue will be transferred to the Firefighting Tool Wedge 110. Such a twisting force is frequently useful in prying open entry ways.

Firefighting Tool Body Vertical Aperture 132 is configured to engage a standard pick or spike end of a hallagan tool. In some embodiments, one or both edges of Firefighting Tool Body Vertical Aperture 132, at one or both of Firefighting Tool Body First Surface 136 and Firefighting Tool Body Second Surface 138, is tapered or rounded.

Firefighting Tool Wedge Slot 114 is configured to engage a standard adze end of a hallagan tool. In the embodiment of FIGS. 2A-D, a standard adze end of a hallagan tool would engage the Firefighting Tool 100 at Firefighting Tool Wedge Slot 114 until reaching slightly less than the center point of the Firefighting Tool 100 because of the two interior protrusions within Firefighting Tool Wedge Slot 114. In another embodiment, the afore-mentioned two interior protrusions are absent and the Firefighting Tool Wedge Slot 114 passes entirely through the interior of the Firefighting Tool 100, forming a uniform cavity. In one embodiment, Firefighting Tool Wedge Slot 114 is shaped with an upper and lower flat or planar portion, in which each terminus forms a semicircular portion to connect the upper and lower portions. In another embodiment, the profile of the Firefighting Tool Wedge Slot 114 is rectangularly shaped. In another embodiment, the termini of the upper and lower portion of the Firefighting Tool Wedge Slot 114 angle toward one another to form a sideways V shape. In one embodiment, the Firefighting Tool Wedge Slot 114 extends towards the wedged-shaped end of the Firefighting Tool 100 past one or more of the transition points between the body and wedge portions of the Firefighting Tool 100, that is past one or both of Firefighting Tool Groove 120 and Firefighting Tool Wedge/Body Transition 122. In another embodiment, the Firefighting Tool Wedge Slot 114 does not extend into the wedged-shaped end of the Firefighting Tool 100 past either one or more of the transition points between the body and wedge portions of the Firefighting Tool 100.

In one embodiment, one or more edges of the Firefighting Tool 100 are rounded, such as Firefighting Tool Body Edge 142 and Firefighting Tool Wedge Prong Edge 113. In one embodiment, Firefighting Tool Groove 120 is of notch shape and traverses the entire width of Firefighting Tool 100. In one embodiment, the Firefighting Tool 100 may be manufactured using computer-numeric control (CNC) machining techniques. In one embodiment, the Firefighting Tool 100 is one of cast, forged and molded from metals or composites.

In one embodiment, Firefighting Tool 100 weighs between 14 ounces and 3 pounds. In a preferred embodiment, Firefighting Tool 100 weighs between 15 ounces and 2 pounds 9 ounces. In a most preferred embodiment, Firefighting Tool 100 weighs approximately 1 pound.

One of ordinary skill in the art will appreciate that embodiments of the present disclosure may be constructed of materials known to provide, or predictably manufactured to provide, the various aspects of the present disclosure. These materials may include, for example, high strength steel, case-hardened steel, stainless steel, titanium alloy, aluminum alloy, chromium alloy, and other metals or metal alloys capable of being used without failure repeated use as a firefighting tool.

In one embodiment, one or more surfaces of the Firefighting Tool 100 are roughed. For example, one or both surface of Firefighting Tool Groove 120 are roughened or textured.

One of ordinary skill in the art will appreciate that embodiments of the present disclosure as provided in FIGS. 1A-D may be used in applications other than firefighting. For example, in any application or situation in which destructive movement or opening is required, such as breaching of glass, removal of a vehicle's trim, and creating purchase points (i.e. opening points) for rescue tools such as hydraulic tools. The tool may be used, for example and without intending to limit the use, for prying, battering, penetrating, pulling, pushing, lifting, cutting, breaking, striking, dragging, door stop, hinge blocking, gas meter shut-off or turn-on, vehicle trim removal, glass breaching, door forcing, peel and peak operations, fire hydrant opening and closing and supporting firefighting and rescue operations.

In one embodiment, the tool is configured to fit within the front or rear pocket of a firefighter's pants. In one embodiment, the tool is configured to fit in a pocket of a firefighter's jacket. In one embodiment, the tool is of one-piece construction. In one embodiment, no dimension of the tool exceeds 8 inches. In one embodiment, the total weight of the tool does not exceed 2 pounds.

EXAMPLE

Without intending to limit the scope of the invention, FIGS. 4A-D depict one example construction of one embodiment of the invention in drawings each to scale. Dimensions are in inches.

As will be appreciated, it would be possible to provide for some features of the inventions without providing others.

To provide further clarity to the Detailed Description provided herein in the associated drawings, the following list of components and associated numbering are provided as follows:

Component
100 Firefighting Tool
110 Firefighting Tool Wedge
112 Firefighting Tool Wedge Prong
113 Firefighting Tool Wedge Prong Edge
114 Firefighting Tool Wedge Slot
115 Firefighting Tool Wedge Slot Distal Edge
116 Firefighting Tool Wedge First Surface
118 Firefighting Tool Wedge Second Surface
120 Firefighting Tool Groove
122 Firefighting Tool Wedge/Body Transition
130 Firefighting Tool Body
132 Firefighting Tool Body Vertical Aperture
134 Firefighting Tool Body Horizontal Cavity
136 Firefighting Tool Body First Surface
138 Firefighting Tool Body Second Surface
140 Firefighting Tool Body Lateral Surface
142 Firefighting Tool Body Edge
150 Firefighting Tool Body Face While various embodiment of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure. Moreover, though the present disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A firefighting tool comprising:

a body having a first surface, a second surface, a pair of lateral surfaces, a vertical aperture and a lateral cavity, the vertical aperture extending through the body between the first and second surfaces, the lateral cavity extending through the body between the pair of lateral surfaces; and a wedge interconnected with the body comprising at least a pair of edges defining a slot.

2. The tool of claim 1, further comprising a groove disposed between the body and the wedge, the groove substantially perpendicular to the at least a pair of edges.

3. The tool of claim 1, wherein the vertical aperture is adapted to engage a pick end of a halligan tool.

4. The tool of claim 1, wherein the lateral cavity is adapted to engage an adze end of a halligan tool.

5. The tool of claim 1, wherein the wedge comprises a symmetrical arcuate profile shape.

6. The tool of claim 1, wherein the slot is adapted to operate as a valve operating tool.

7. The tool of claim 1, wherein the tool is manufactured of a high-strength material comprising high strength steel, case-hardened steel, titanium and beryllium copper.

8. The tool of claim 1, wherein the tool is of one-piece construction.

9. The tool of claim 1, wherein no dimension of the tool exceeds 8 inches.

10. The tool of claim 1, wherein the total weight of the tool does not exceed 2 pounds.

11. A firefighting tool, comprising:

a body having a first surface, a second surface, a pair of lateral surfaces, a vertical aperture and a lateral cavity, the lateral cavity extending through the body between the pair of lateral surfaces, the vertical aperture adapted to engage a pick of a halligan tool and the lateral cavity adapted to engage an adze of the halligan tool, the pick and the adze at a distal end of the halligan tool; and a wedge interconnected with the body;

wherein the firefighting tool extends from the distal end of the halligan when the firefighting tool is engaged with one of the pick and the adze of the halligan tool.

12. The tool of claim 11, further comprising a groove disposed between the body and the wedge.

13. The tool of claim 11, wherein the wedge comprises a symmetrical arcuate profile shape.

14. The tool of claim 11, wherein the wedge comprises a slot adapted to operate as a valve operating tool.

15. The tool of claim 11, wherein the tool is manufactured of a high-strength material comprising high strength steel, case-hardened steel, titanium and beryllium copper.

16. The tool of claim 11, wherein the tool is of one-piece construction.

17. The tool of claim 11, wherein no dimension of the tool exceeds 8 inches.

18. The tool of claim 11, wherein the total weight of the tool does not exceed 2 pounds.

19. A method of using a halligan tool and firefighting tool assembly, comprising:

providing a firefighting tool, the tool comprising:

a body having a first surface, a second surface, a pair of lateral surfaces, a vertical aperture and a lateral cavity, the lateral cavity extending through the body between the pair of lateral surfaces, the vertical aperture adapted to engage a pick of a halligan tool and the lateral cavity adapted to engage an adze of the halligan tool, the pick and the adze at a distal end of the halligan tool; and a wedge portion comprising at least a pair of edges defining a slot;

providing the halligan tool;

interconnecting the halligan tool with the firefighting tool by one of: 1) the pick of the halligan tool with the vertical aperture and 2) the adze of the halligan tool with the lateral cavity; and engaging an external surface with the halligan tool and firefighting tool assembly to at least one of force-entry, pry, wedge, strike, hammer, twist and destructively transfer energy.

20. The method of claim 19, the tool further comprising a groove disposed between the body and the wedge, the groove substantially perpendicular to the at least a pair of edges, wherein the slot is adapted to operate as a valve operating tool.

* * * * *